US005609003A

United States Patent [19]

Jouty

[11] Patent Number: 5,609,003

[45] Date of Patent: Mar. 11, 1997

[54] MODULAR CONSTRUCTION SYSTEM

[76] Inventor: Chris G. Jouty, 444 Hwy. 628, LaPlace, La. 70068

[21] Appl. No.: 556,380

[22] Filed: Nov. 13, 1995

[51] Int. Cl.[6] ..... E04B 1/48

[52] U.S. Cl. ..... 52/585.1; 52/285.1; 52/285.4

[58] Field of Search ..... 52/270, 284, 285.1, 52/285.9, 582.1, 585.1, 585.2, 271, 589.1; 403/230, 231, 258; 411/404, 105, 85, 432

[56] References Cited

U.S. PATENT DOCUMENTS

| | | | |
|---|---|---|---|
| 2,635,450 | 4/1953 | Orzel | 52/582.1 |
| 3,600,870 | 8/1971 | Greenhalgh | 52/745 |
| 3,665,662 | 5/1972 | Timbrook et al. | 52/270 |
| 3,835,610 | 9/1974 | Harper et al. | 52/755 |
| 3,854,746 | 12/1974 | Flynn et al. | 280/125 |
| 3,872,642 | 3/1975 | Felix | 52/584.1 X |
| 3,884,002 | 3/1975 | Logie | 52/585.1 X |
| 4,012,880 | 5/1975 | Logie | 52/585.1 |
| 4,030,846 | 6/1977 | Flototto | 403/231 |
| 4,045,927 | 9/1977 | Diaz | 52/127.1 |
| 4,067,165 | 1/1978 | Timmons | 52/585.1 |
| 4,116,573 | 9/1978 | Fuchs | 403/264 |
| 4,261,665 | 4/1981 | Hsiung et al. | 403/258 X |
| 4,299,067 | 11/1981 | Bertschi | 52/585.1 X |
| 4,514,938 | 5/1985 | Maguire | 52/79.4 |
| 4,843,788 | 2/1989 | Gavin et al. | 52/205 |
| 5,032,047 | 7/1991 | Theakston | 411/104 |

*Primary Examiner*—Carl D. Friedman
*Assistant Examiner*—Beth A. Aubrey
*Attorney, Agent, or Firm*—Joseph N. Breaux

[57] ABSTRACT

A modular construction system that includes a plurality of shaped building sections having spaced connecting apertures positioned along sections of the perimeter thereof, a plurality of disconnectable fasteners, and a plurality of connecting aperture plugs. The connecting apertures include two cylindrical shaped fastener bores of equal diameter intersecting at about a ninety degree angle and at a predetermined distance from an exterior opening of each of the two fastener bores.

15 Claims, 6 Drawing Sheets

MODULAR CONSTRUCTION SYSTEM

TECHNICAL FIELD

The present invention relates to systems for constructing buildings and more particularly to a system for constructing small storage type buildings that includes the use of a variety of building sections that have preformed, connecting apertures and that are fastenable together to form a desired configuration building which may be assembled and disassembled through the use of disconnectable fasteners such as bolt and nut assemblies.

BACKGROUND ART

It is often necessary, for a variety of reasons, to have covered and lockable storage space for items. One solution to such a storage problem is to provide a separate building dedicated to storage of items such as lawn mowers, tools, paint, unused furniture and the like. These separate building are usually shell enclosures that minimally provided protection from the elements and theft. Although these buildings are often termed portable, moving such buildings often requires the use of specialized lifting and moving equipment. It would be a benefit, therefore, to have a modular construction system for constructing small storage-type buildings that included a variety of interconnectable building sections that were readily connected to form a desired storage building and disconnected for convenient removal or transfer to a different location without specialized lifting or transport equipment.

GENERAL SUMMARY DISCUSSION OF INVENTION

It is thus an object of the invention to provide a modular construction system that includes a variety of interconnectable building sections that are readily connected to form a desired storage building and disconnected for convenient removal or transfer to a different location without specialized lifting or transport equipment.

Accordingly, a modular construction system is provided. The construction system includes a plurality of rectangular shaped building sections having spaced connecting apertures positioned around the perimeter thereof, a plurality of triangular shaped building sections having spaced connecting apertures positioned along sections of the perimeter thereof, a plurality of L-shape building sections having spaced connecting apertures positioned along sections of the perimeter thereof, a plurality of roof building sections each having one pair of mitered sides and spaced connecting apertures positioned along an opposed pair of perimeter edges thereof, a plurality of disconnectable fasteners, and a plurality of connecting aperture plugs. The term connecting apertures is used herein to mean two cylindrical shaped fastener bores of equal diameter intersecting at about a ninety degree angle and at a predetermined distance from an exterior opening of each of the two fastener bores. The connecting aperture plug has a head portion larger than the diameter of the fastener bores, a shaft having a diameter selected to allow snug positioning of the shaft within the fastener bore, and a shaft aperture passing through the shaft that is alignable with one of the fastener bores when inserted into the other fastener bore at a point where the head of the connecting aperture plug contacts the exterior surface of the building section.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
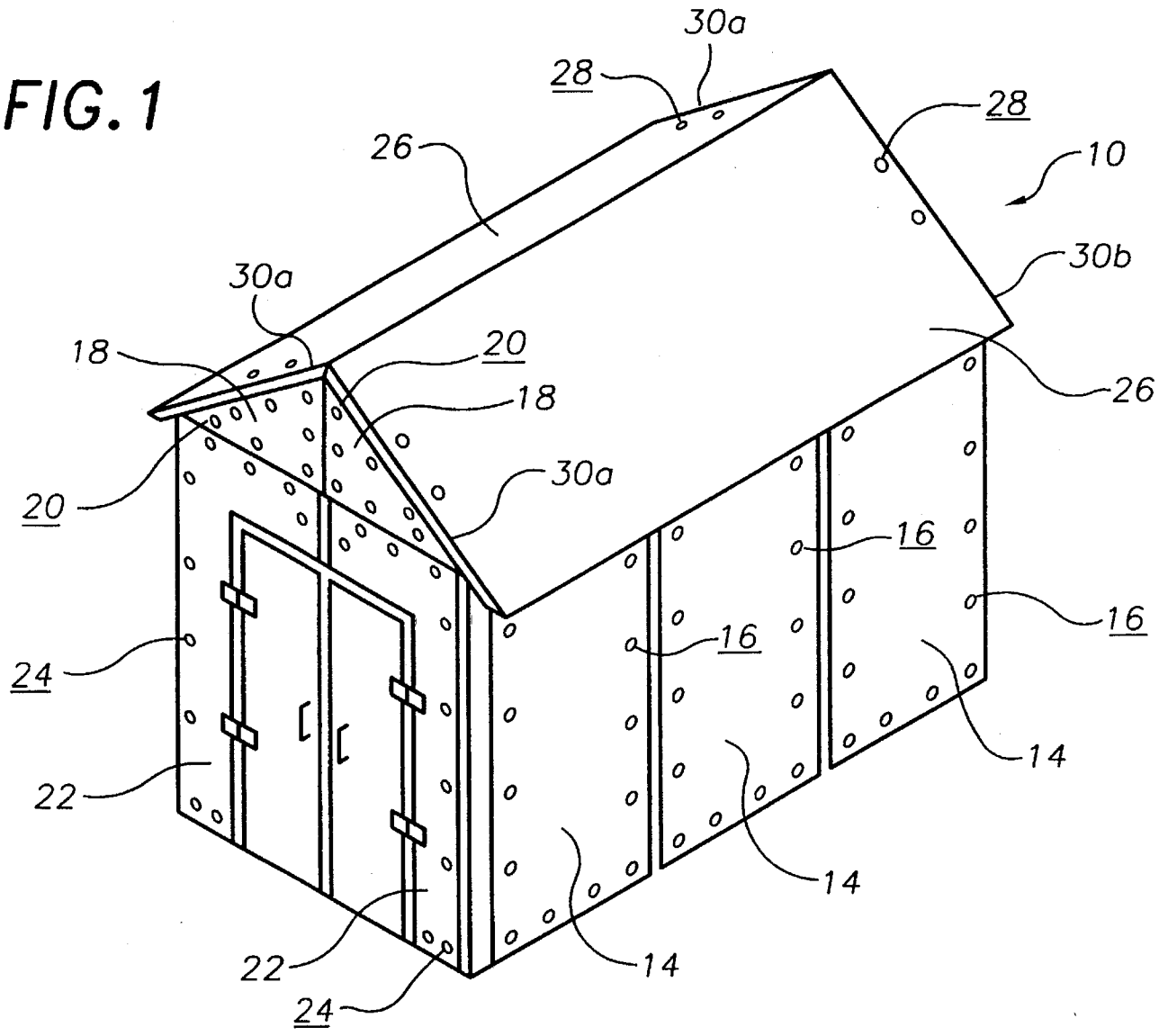
FIG. 1 is a perspective view of a representative building constructed with an exemplary embodiment of the modular building system of the present invention.

An exemplary embodiment of the modular construction system of the present invention is now described with reference to FIGS. 1–6. FIG. 1 shows a representative building, generally referenced by the numeral 10, of the type that may be constructed using the modular construction system. The modular construction system includes a variety of interconnectable building sections that are disconnectably connectable to form a variety of user selected building shapes. The term "disconnectably connectable" is used herein to mean connectable and disconnectable without damaging the fastener or the building section beyond use. In this exemplary embodiment, the building system includes rectangular shaped wall and floor building sections 14 having spaced connecting apertures 16 positioned around the perimeter thereof; triangular shaped roof support building sections 18 having spaced connecting apertures 20 positioned along sections of the perimeter thereof; L-shaped door mounting building sections 22 having spaced connecting apertures 24 positioned along sections of the perimeter thereof; rectangular shaped roof building sections 26 having spaced connecting apertures 28 positioned along an opposed pair of perimeter edges 30*a*, 30*b* thereof; and, with reference to FIG. 2, a supply of bolt assemblies, generally referenced by the numeral 32; and a supply of connecting aperture plugs 34.

Figure 2:
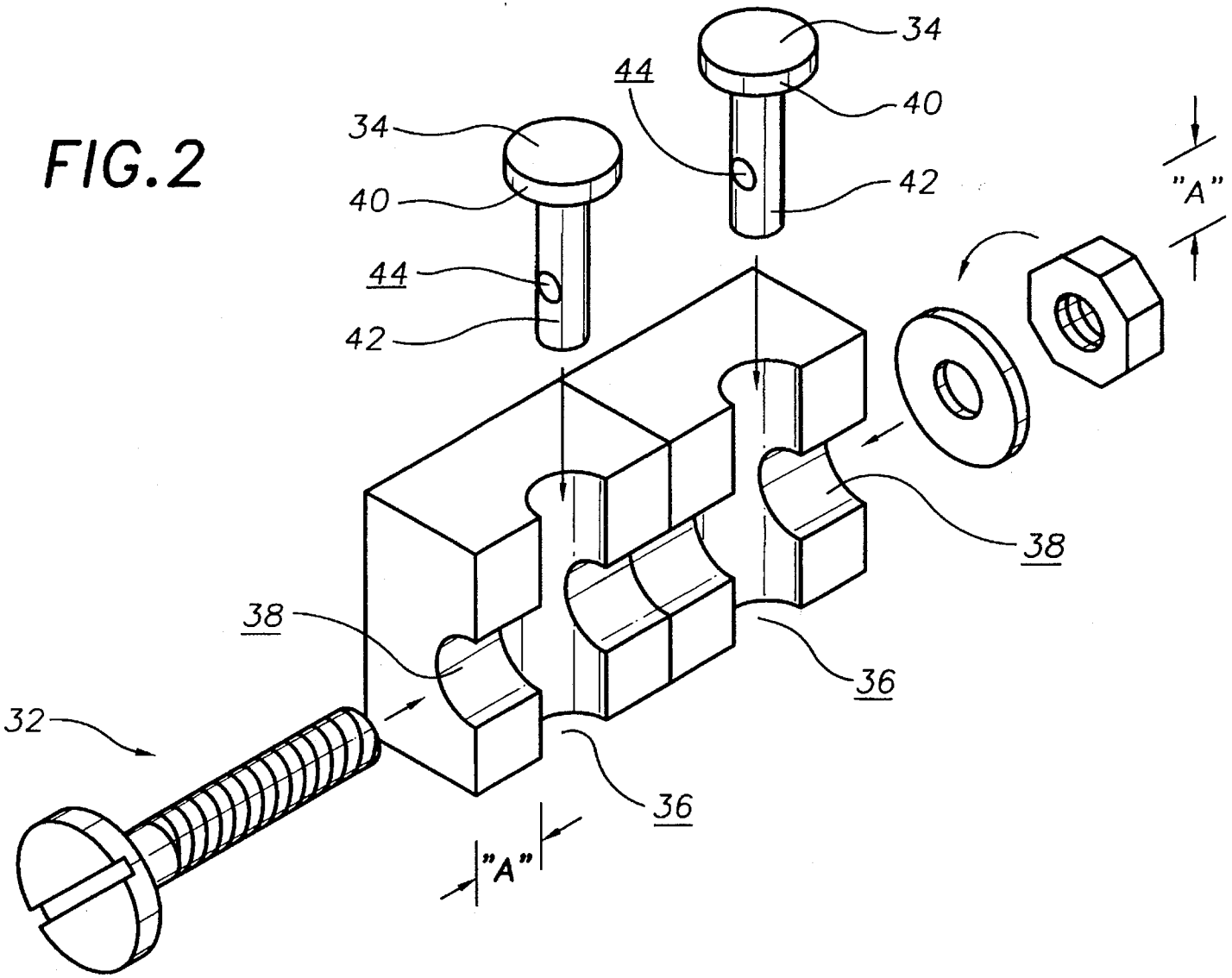
FIG. 2 is a perspective view showing cross sectional views of the connecting apertures from two modular sections positioned adjacent one another showing installation of the disconnectable fastener and a pair of connecting aperture plugs.

FIG. 2 shows the internal structure of all connecting apertures 16, 20, 24, 28. Each connecting aperture 16, 20, 24, 28 includes two cylindrical shaped fastener bores 36, 38 of about equal diameter that intersect at about a ninety degree angle and at a depth "A" of about one (1") inch from any exterior opening to either fastener bore 36, 38. Each connecting aperture plug 34 has a head portion 40 larger than the diameter of fastener bores 36, 38; a shaft 42 having a diameter selected to allow snug positioning of shaft 42 within fastener bores 36, 38; and a shaft aperture 44 that is alignable with one of the fastener bores 36, 38 when shaft 42 is inserted into the other fastener bore 36, 38 at a point where head portion 40 contacts the exterior surface of a building section 14, 18, 22, 26.

Connecting apertures 16, 20, 24, 28 are spaced along perimeter edges of the various building sections 14, 18, 22, 26 in a manner such that the connecting apertures 16, 20, 24, 28 of one building section 14, 18, 22, 26 are alignable with at least one of the connecting apertures 16, 20, 24, 28 of other adjacently positioned building sections 14, 18, 22, 26. The adjacent building sections are securely connected using a number of bolt assemblies 32 and a number of the connecting apertures 16, 20, 24, 28.

The unused connecting apertures 16, 20, 24, 28 are sealed by inserting a connecting aperture plug 34 in each unused fastener bore 36, 38 and aligning the plug aperture with the fastener bore 36, 38 through which the bolt 46 of the bolt assembly 32 is to be placed prior to placement of the bolt 46 therethrough. Once each bolt 46 is in place, a washer 48 is placed over the end thereof and a nut 48 is torqued down to secure the adjacent building sections 14, 18, 22, 26 together.

As shown in FIG. 1, a number of bolt assemblies 32 are utilized to secure each pair of adjacent building sections 14, 18, 22, 26 together. Because the connection between adjacent building sections 14, 18, 22, 26 may use different combinations of fastener bores 36, 38, adjacent building sections may be connected at angles of either one-hundred-eighty (180°) or ninety (90°) degrees.

Figure 3:
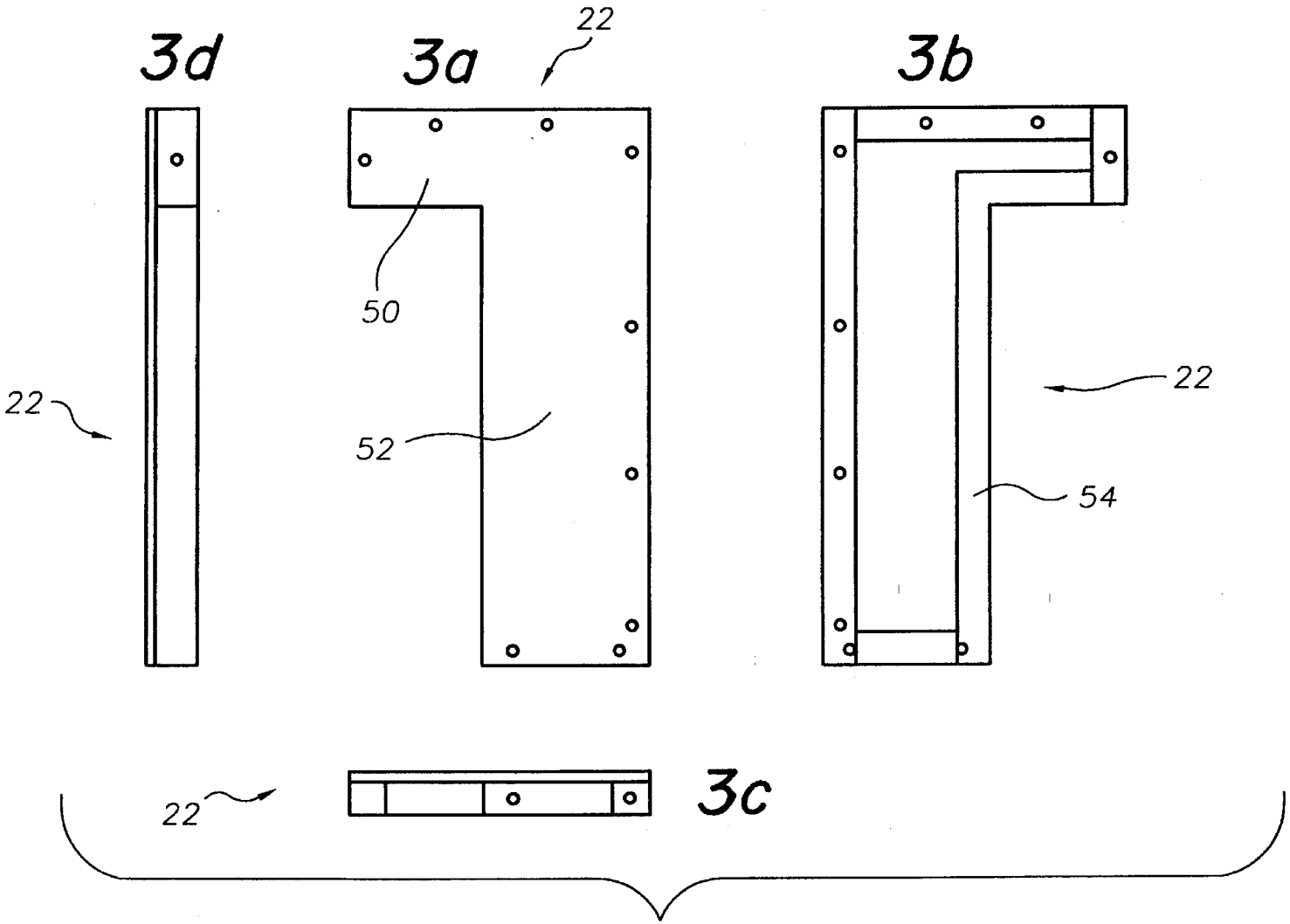
FIG. 3 (3*a*–3*d*) is a series of plan views of an exemplary L-shaped door mounting section of the modular construction system.

FIG. 3 is a series of plan views (FIGS. 3*a*–3*d*) showing exemplary L-shaped building section 22. Each L-shaped building section 22 has a two foot by one foot extension portion 50, an plywood exterior surface 52, and an interior perimeter board frame 54.

Figure 4:
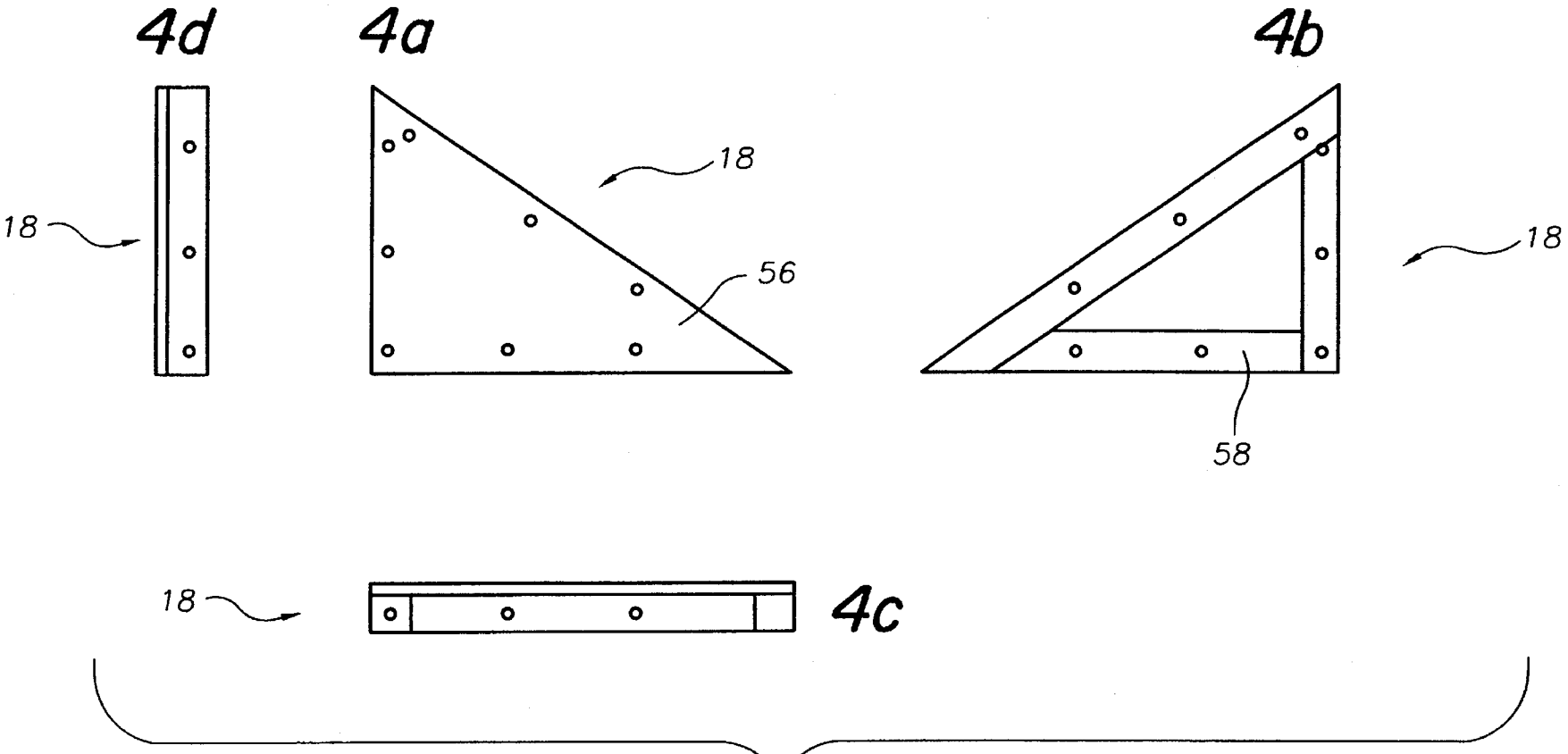
FIG. 4 (4*a*–4*d*) is a series of plan views of an exemplary triangular shaped roof support section of the modular construction system.

FIG. 4 is a series of plan views (FIGS. 4*a*–4*d*) showing exemplary triangular shaped roof support building section 18. Each roof support building section 18 has a plywood exterior surface 56, and an interior perimeter board frame 58.

Figure 5:
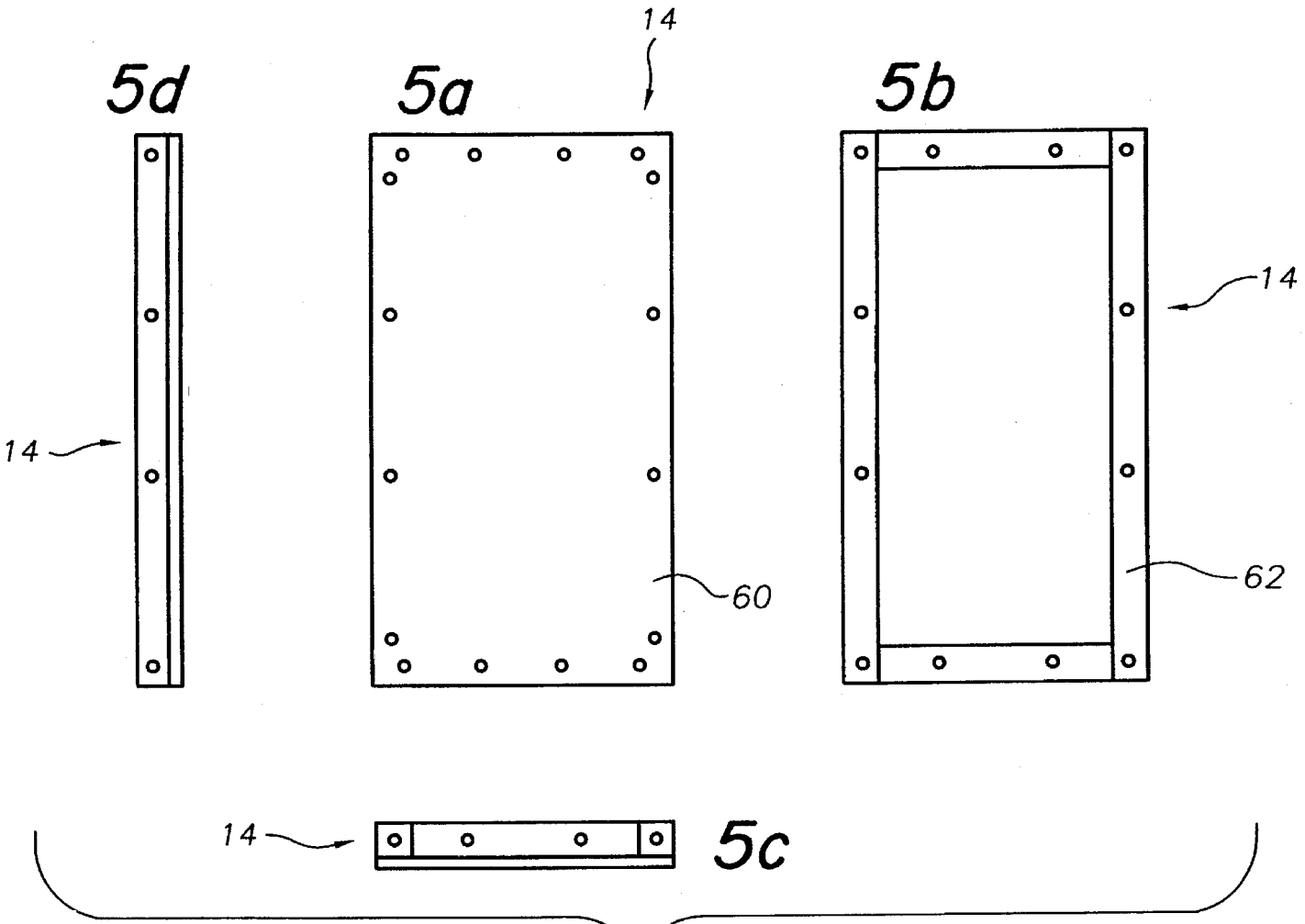
FIG. 5 (5*a*–5*d*) is a series of plan views of an exemplary rectangular shaped floor or wall section of the modular construction system.

FIG. 5 is a series of plan views (FIGS. 5*a*–5*d*) showing exemplary rectangular shaped floor and wall building section 14. Each floor and wall building section 14 has a plywood exterior surface 60, and an interior perimeter board frame 62.

Figure 6:
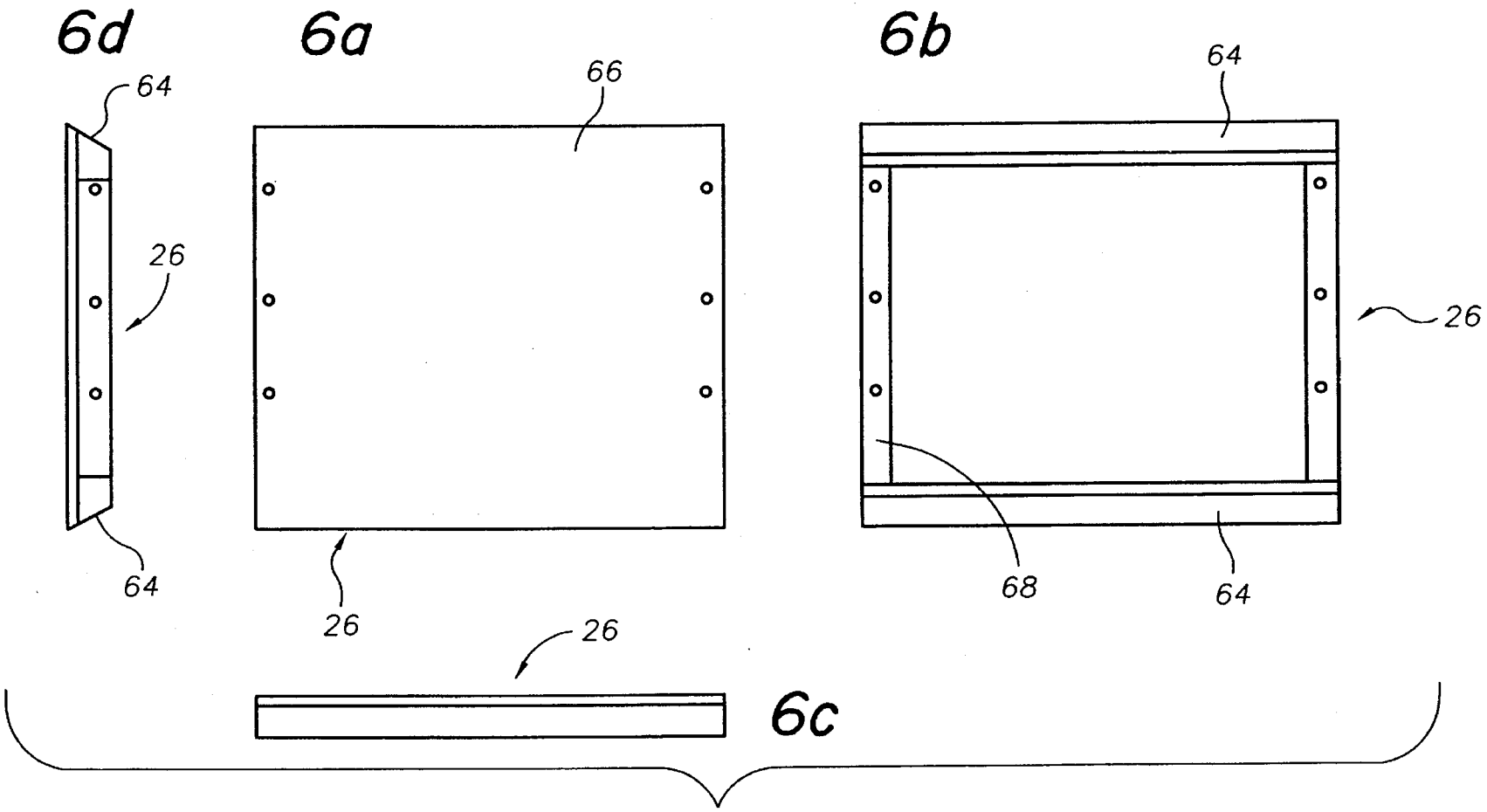
FIG. 6 (6*a*–6*d*) is a series of plan views of an exemplary rectangular shaped roof section of the modular construction system.

FIG. 6 is a series of plan views (FIGS. 6*a*–6*d*) showing exemplary rectangular roof building section 26. Each roof building section 26 has an opposed pair of beveled side edges 64, a plywood exterior surface 60, and an interior perimeter board frame 62.

It can be seen from the preceding description that a modular construction system has been provided that includes a variety of interconnectable building sections that are readily connected to form a desired storage building and disconnected for convenient removal or transfer to a different location without specialized lifting or transport equipment. In addition, the use of connecting aperture plugs for sealing unused fastener bores 36, 38 allows the building sections 14, 18, 22, 26 to be connected in a variety of configurations.

It is noted that the embodiment of the modular construction system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A modular construction system comprising:

a plurality of building sections having connecting apertures positioned along at least a section of a perimeter thereof, each connecting aperture having two fastener bores of equal dimension intersecting at about a ninety degree angle and at a predetermined distance from an opening of each of said two fastener bores formed through an exterior surface of one of said plurality of building sections;

a quantity of connecting aperture plugs having a head portion too large to pass into any said fastener bore, a shaft portion having dimensions selected to allow snug positioning of said shaft portion within a said fastener bore, and a smooth bore shaft aperture passing through said shaft portion that is alignable with one of said fastener bores when positioned within said intersecting fastener bore, said shaft aperture being spaced from said head portion in a manner such that when said shaft portion is inserted into a fastener bore of one of said connecting apertures a center of said shaft aperture is aligned with a center of the other perpendicularly oriented fastener bore forming the one of said connecting apertures when said head portion contacts an exterior surface of a building section; and a quantity of fastener assemblies having a bolt having a shaft portion insertable through said shaft aperture and a threaded end positioned out of said fastener bore, and a nut, companionately threaded for connection with said threaded end.

2. The modular construction system of claim 1, wherein:

said plurality of building sections including at least one said building section having a rectangular shaped perimeter.

3. The modular construction system of claim 1, wherein:

said plurality of building sections including at least one said building section having an L-shaped perimeter.

4. The modular construction system of claim 1, wherein:

said plurality of building sections including at least one said building section having a triangular shaped perimeter.

5. The modular construction system of claim 1, wherein:

said plurality of building sections including at least one said building section having a rectangular shaped perimeter and an opposed pair of beveled side edges.

6. The modular construction system of claim 1, wherein:

said plurality of building sections including at least one said building section having a rectangular shaped perimeter; and at least one said building section having an L-shaped perimeter.

7. The modular construction system of claim 1, wherein:

said plurality of building sections including at least one said building section having a rectangular shaped perimeter; and at least one said building section having a triangular shaped perimeter.

8. The modular construction system of claim 1, wherein:

said plurality of building sections including at least one said building section having a rectangular shaped perimeter; and at least one said building section having a rectangular shaped perimeter and an opposed pair of beveled side edges.

9. The modular construction system of claim 1, wherein:

said plurality of building sections including at least one said building section having an L-shaped perimeter; and at least one said building section having a triangular shaped perimeter.

10. The modular construction system of claim 1, wherein:

said plurality of building sections including at least one said building section having an L-shaped perimeter; and at least one said building section having a rectangular shaped perimeter and an opposed pair of beveled side edges.

11. The modular construction system of claim 1, wherein:

said plurality of building sections including at least one said building section having a triangular shaped perimeter; and at least one said building section having a rectangular shaped perimeter and an opposed pair of beveled side edges.

12. The modular construction system of claim 9, wherein:

said plurality of building sections including at least one said building section having a rectangular shaped perimeter.

13. The modular construction system of claim 10, wherein:

said plurality of building sections including at least one said building section having a rectangular shaped perimeter.

14. The modular construction system of claim 11, wherein:

said plurality of building sections including at least one said building section having a rectangular shaped perimeter.

15. The modular construction system of claim 14, wherein:

said plurality of building sections including at least one said building section having an L-shaped perimeter.

* * * * *